United States Patent [19]

Iaconetti et al.

[11] 4,134,285

[45] Jan. 16, 1979

[54] METHOD AND APPARATUS FOR PRODUCING MULTIPLE GROOVE PULLEYS

[75] Inventors: Frank A. Iaconetti; G. Michael Gnora; Carl J. Novak, all of Akron, Ohio

[73] Assignee: The Rogers Mfg. Co., Akron, Ohio

[21] Appl. No.: 823,939

[22] Filed: Aug. 12, 1977

[51] Int. Cl.[2] ..... B21H 1/00

[52] U.S. Cl. ..... 72/84; 72/105; 29/159 R

[58] Field of Search ..... 72/84, 105, 106; 29/159 R

[56] References Cited

U.S. PATENT DOCUMENTS

| | | | |
|---|---|---|---|
| 3,457,751 | 7/1969 | Lindeman | 72/105 |
| 4,050,321 | 9/1977 | Kraft | 29/159 R |
| 4,055,977 | 11/1977 | Haswell | 29/159 R |

*Primary Examiner*—Lowell A. Larson
*Attorney, Agent, or Firm*—Reese Taylor

[57] ABSTRACT

A method and apparatus for forming pulleys or similar cylindrical objects having three or more V-shaped peripheral grooves from a single piece of material is disclosed. The apparatus comprises an inner support assembly which includes at least two rotary support rolls joined together by spring means so that they may move axially relatively of each other. The method and apparatus also includes utilization of conventional exteriorly mounted preliminary preforming and final shaping rollers having the appropriate number of shaping members and with the inner rolls cooperating with the exterior rolls and being capable of moving toward and away from each other as the metal is drawn down by the exterior final shaping rolls.

6 Claims, 4 Drawing Figures

METHOD AND APPARATUS FOR PRODUCING MULTIPLE GROOVE PULLEYS

BACKGROUND OF THE INVENTION

This invention, in general, relates to the art of spin forming V-belt pulleys or similar cylindrical members having V-shaped peripheral grooves therein and in particular relates to forming such pulleys with three or more peripheral grooves from a single cup shaped piece of metal.

DESCRIPTION OF THE PRIOR ART

The prior art, in general, can be placed in two categories with regard to forming pulleys having three or more peripheral grooves therein.

First, the well known and long established method is to spin form a pulley having two grooves by means of exterior shaping rollers and interior support rollers and then forming a separate one groove piece followed by welding or otherwise securing the two pieces thus formed together to form an overall product having three peripheral grooves. This method, of course, could be utilized to form more than three grooves, if desired.

The disadvantages of such a system, however, are numerous. First, there is definitely a disadvantage in cost because of the fact that two separate forming operations are required plus a joining operation. This naturally increases the production time required and also the amount of machinery and the overall cost.

A further disadvantage of this particular system is the fact that the resulting pulley has an increased weight due to the presence of the flange on one of the pieces which is welded to the other and this is disadvantageous in many uses. For example, in using pulleys of this nature in the automotive field with the current trend toward weight reduction to decrease fuel consumption, since a number of these pulleys are present in most automobiles, any weight saving achieved is of considerable value. Additionally, there is wastage of material with this type of method.

The second general method type by the prior art is perhaps best illustrated by Killian et al U.S. Pat. No. 3,852,863 which does disclose means for spin forming a V-groove pulley with at least three grooves from a single cup-shaped sheet metal blank. This method, however, generally involves two separate operations. In other words, the first two grooves are formed and the pulley thus formed is transferred to a second machine where the third groove is formed. This particular teaching also includes an expandable mandrel concept for the interior support function which, while workable, has the disadvantage of being relatively complex and, therefore, in the event of any failure or damage to the supporting mandrel time consuming repair would be required.

BRIEF SUMMARY OF THE INVENTION

It has been found that the ultimate object of the prior art just discussed, namely to form a pulley having at least three peripheral grooves from a single cup-shaped metal blank in one continuous operation, can be achieved simply, rapidly and economically.

Thus, one of the objects of the invention is to provide a method and apparatus for producing pulleys of this nature utilizing the usual external finishing and shaping rolls having suitable projections for three or more grooves in conjunction with an internal support roll assembly having suitable roll members for three or more grooves with the internal member having the rolls joined together by springs so that, as the preliminary shaping rolls and the final shaping rolls perform their operation and reduce the actual heighth of the blank, the inner rolls can travel freely axially in response to that movement while providing firm backup to the finishing and shaping rollers. The number of spring connected rollers involved can vary, but in order to provide the desired basic three groove pulley, two are necessary.

Accordingly, production of an improved method and apparatus for forming three groove pulleys or the like becomes the principal object of this invention with other objects thereof becoming more apparent upon a reading of the following brief specification considered and interpreted in view of the accompanying drawings.

BRIEF DESCRIPTION OF THE PREFERRED EMBODIMENT

Figure 1:
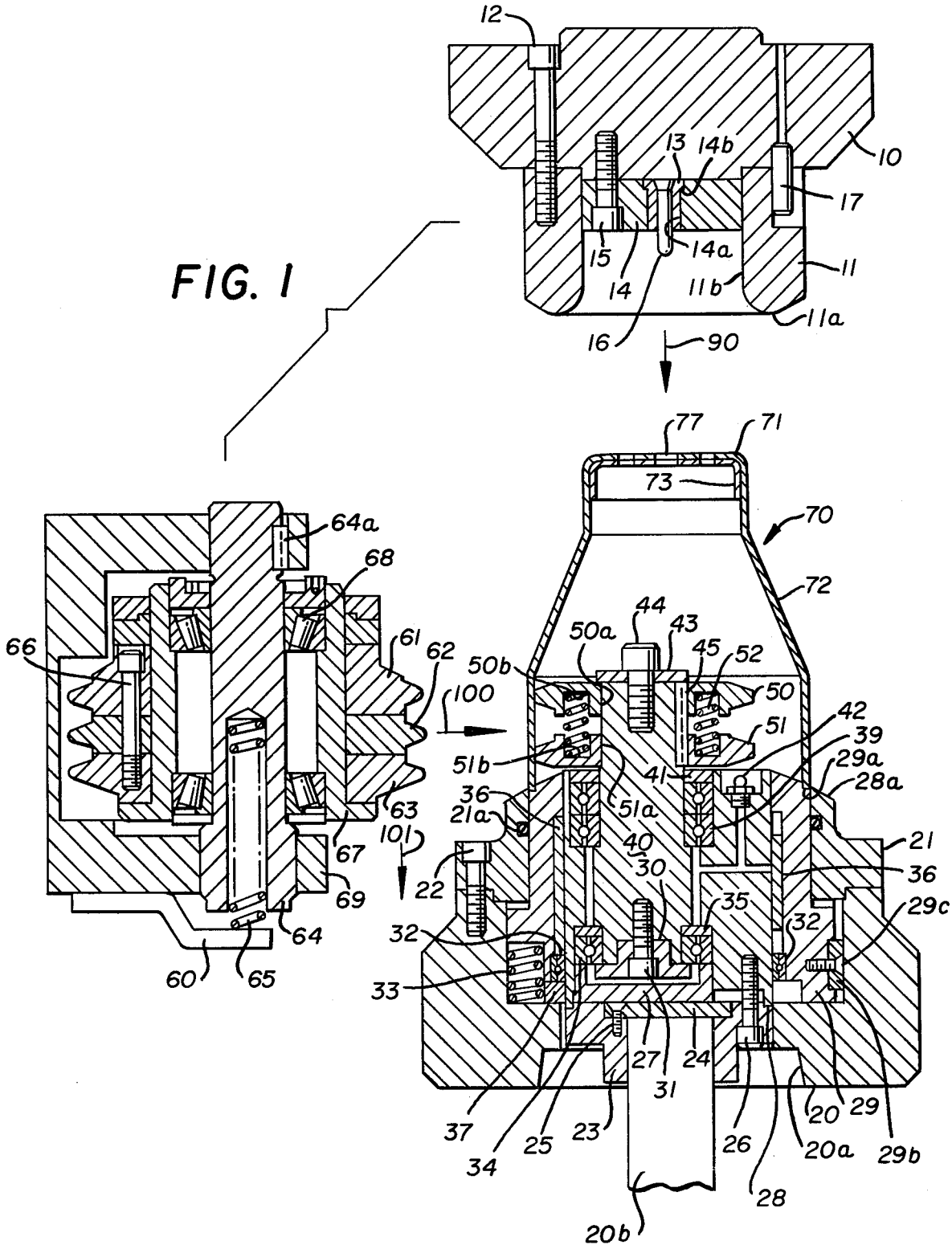
FIG. 1 is a cross-sectional view of the basic assembly required to finish the pulley and is shown in an open position and somewhat schematically.

Referring first, then, to FIG. 1, it should be noted that much of the assembly herein is shown schematically only. Thus, the prior art and those skilled in the field are well aware of the normal apparatus for spin forming pulleys which will generally include a press, movable between open and closed positions, a preforming roller assembly which is movable inward and outward into and out of contact with the cup-shaped blank and a profiling or final shaping roller likewise movable into and out of contact with the work. Apparatus of this general nature is quite fully disclosed in patents such as Schroder U.S. Pat. Nos. 2,779,060 and 3,823,591 and Bichel 3,962,896.

Therefore, in the drawings only the portions of the known apparatus believed necessary to carry out the improved step of forming three of more grooves from a single blank has been illustrated for the sake of simplicity. It is believed that the remaining structure would be well within the knowledge of one reasonably skilled in this art.

Figure 2:
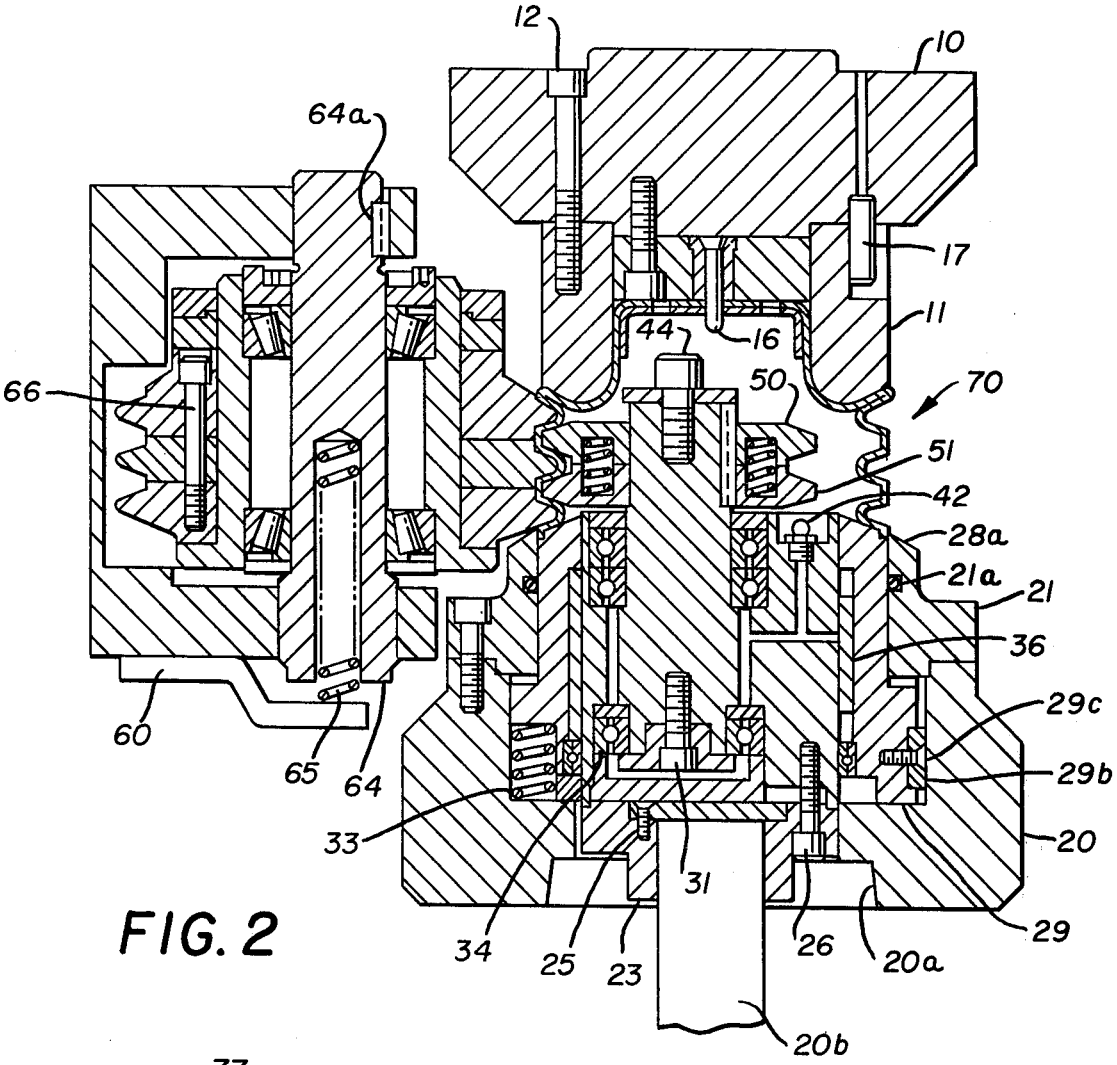
FIG. 2 is a view after the roll has been finished with the parts of the assembly brought together and is also shown somewhat schematically.

Therefore, turning then to FIG. 1, it will be noted that the assembly for forming the pulley includes an upper mounting ring 10 which would be conventionally held by a press capable of moving in the direction of the arrow 90 from the open position of FIG. 1 to the closed position of FIG. 2. The press itself is not further illustrated in accordance with the foregoing remarks.

The upper mounting ring 10 carries a forming ring 11 thereon with the ring 11 being annular in configuration and having a central bore **11*b* and terminating in an arcuate bottom surface 11*a* for purposes which will be described. The forming ring is secured to the upper mounting ring by the screw 12 and, in this regard, a number of screws would normally be used although only one is illustrated in the sectional view of FIG. 1**. A dowel 17 is also press fit in ring 10 and employed for locating and orientation purposes.

Received within the central bore 11*b* of the forming ring 11 is a pilot holder 14 which is secured to the upper mounting ring 10 by means of a screw or screws 15. The pilot holder 14 also has a central bore 14*a* which is counterbored to form a shoulder 14*b* adjacent its top end.

Received in the bore 14*a* of pilot holder 14 is a cylindrical retainer 13 which is T-shaped in cross-section and which can be seated on the shoulder 14*b*. This retainer 13 holds the projecting pilot 16 which is mounted coaxially with regard to the upper mounting ring and the upper forming ring for purposes which will be described.

Turning to the lower mounting ring 20, it will be first noted that this ring would likewise be mounted in a supporting platen or press structure which is not illustrated since such structure is relatively conventional in the prior art.

A holding ring 21 is received on the top of the lower mounting ring 20 and is secured thereto by a plurality of screws 22, 22. Both the lower mounting ring and the holding ring are cylindrical in nature and have a hollow center which contain the remaining components of the lower assembly as will be described.

Thus, a mounting disc 23 is received in the lower mounting ring 20 and receives the fixed support shaft 20*b*. A cover plate 24 is also received on the top of the mounting disc 23 and is secured thereto by a plurality of screws 25. Mounting disc 23 is also secured to center module 28 by means of a plurality of screws 26. Surrounding the center module 28 is a support ring 29. The support ring 29 is elongate and cylindrical in nature and has an annular locating notch 29*a* in its top surface for purposes which will be described. A key 29*b* is also inserted in the lower periphery of the member 29 and held in place by means of screw 29*c*.

Thus, lower mounting ring 20, holding ring 21 and support ring 29 are secured together for movement in unison.

Furthermore, spaced between the stationary center module 28 and the support ring 29 are thrust bearings 32, 32 and roller bearings 36, 36 with these members being disposed about the periphery of the center module 28.

Also disposed about the periphery of the holding ring 21 is an O-ring 21*a* for sealing purposes.

Furthermore, the usual die springs 33, 33 are utilized although only one is illustrated and the springs are trapped beneath an undercut portion of the center module 28 and a ledge portion of the lower mounting ring 20.

A retainer ring 27 is received on top of the cover plate 24 and supports retainers 37, 37 and spacers 35, 35. The retainers 37, 37 trap a second retainer 30 against the top face of the retainer 27. A screw 31 is inserted through the second retainer 30 and engages the free wheeling spindle or shaft 40 which is mounted for rotational movement. At the top of the spindle 40 is a third retainer 43 held in place by screw 44.

The bottom face of lower mounting ring 20 has a frustoconical cut out area which can be received on a tapered nose (not shown) to impart driving force to the rings 20, 21 and 29 as will be described.

It should also be noted that ball bearings 39, 39 are received about the periphery of the spindle 40 and a cover plate 41 is employed to hold the same in place. Also, grease fitting 42 is provided in the top of center module 28 and communicates with the unnumbered passageways thereof for lubrication purposes.

Received on top of spindle 40 is a retainer 43 held in place by screw 44 and trapping key 45 for purposes which will now be described.

The inner forming rolls 50 and 51 have interior axial openings 50*a* and 51*a* so that they can be slipped in place on spindle 40 and held thereon by key 45. These rolls (50 and 51) have appropriate peripheral contours so that, when used in cooperation with the finishing rolls, they will provide proper inner support to produce the finished grooves in the pulleys.

Inner rolls 50 and 51 also have one or more recesses 50*b*, 51*b* formed in their mating faces and these recesses receive springs 52, 52 which will normally tend to urge rolls 50 and 51 apart.

Still referring to FIG. 1 it will be noted that the final finishing rolls 61, 62, 63 are mounted to the left of FIG. 1. These rolls are carried by a support 60 and frame 69 all of which is movable in the direction of arrow 100 to perform the finish forming operation.

Rolls 61, 62, 63 are mounted on a spindle 64 and appropriate bearings 68, 68 are provided between the rolls and the spindle. While the rolls 61, 62 and 63 are held together by screw 66 the entire assembly can move in the direction of arrow 101 against the force of spring 65 along the longitudinal axis of spindle 64 which is held in frame 69 by key 64*a*. Operation of final finishing rolls 61, 62, 63 will be more fully described below although it should be noted that the means for moving these rolls toward and away from the press is not shown since it is essentially conventional.

The preliminary shaping rolls are also not illustrated herein since they are also essentially conventional in construction.

In use or operation of the improved invention, it will first be noted that the press would be opened as shown in FIG. 1. Following this, the preformed cup-shaped blank 70 would be inserted so that its bottom edge surface rests in the locating notch 29*a* in the top of support ring 29 and is, in fact, trapped in place between the upstanding lip 28*a* of the holding ring 21 to thereby securely locate it.

The press is then closed in the direction of the arrow 90 with the pilot 16 passing into the aperture 77 in the base of the blank. Following this, the preforming roll assembly is advanced and, with the blank spinning, will perform the initial rough spin forming operation. This will result in drawing the metal and in preliminary grooves being formed in the periphery of the blank 70.

The structure of the preforming roller assembly is not illustrated herein as noted. This type of assembly is well known in the art and, in fact, is essentially the same as the structure of the final finishing roll assembly shown to the left of FIGS. 1 and 2, although located 90° from the location of the final finishing roll assembly. It should also be noted that inner rolls 50 and 51 are eccentrically located with respect to the main axis of the press and thus play no part in the initial preforming operation.

Once the preforming roll assembly has performed its function, it will be retracted and the final finishing roll assembly will advance inward as shown in FIG. 2. At this time, with all of the parts spinning, the final finishing rollers 61, 62, and 63 will be driven into the preformed grooves to form final grooves 74, 74 and will draw the blank to its final condition. During this operation the metal will be drawn toward the bottom of the press and rolls 61, 62 and 63 can accomplish this by moving down spindle 64 against the force of spring 65.

Figure 3:
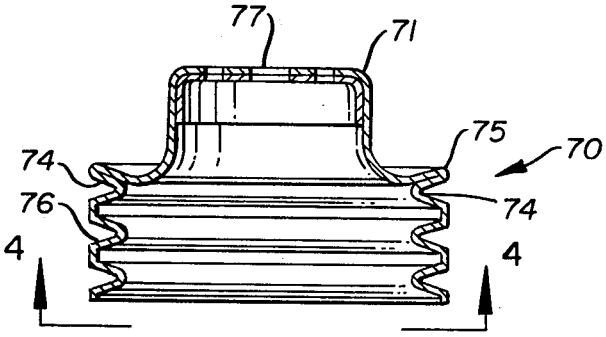
FIG. 3 is a sectional view of the finished pulley.
Figure 4:
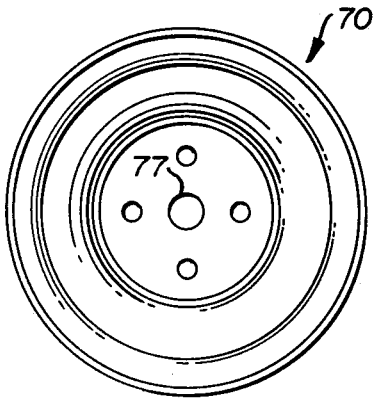
FIG. 4 is a view taken along the line 4—4 of FIG. 3.

As this happens, the support rolls 50 and 51 on the inside will rotate with freewheeling spindle 40 and will travel toward each other as the metal is drawn down so that the final groove configuration shown in FIG. 2 and 3 will be achieved. This is all accomplished in one operation without any movement or displacement of the blank 70 and results in concentric and dynamically balanced grooves.

When the final roll spin forming has been completed, as just noted, the finishing roll assembly will be withdrawn and the press will be opened returning the components to the position shown in FIG. 1 of the drawings following which it is a simple matter to remove the finished product 70 which will have, in the form of the invention illustrated, three peripheral grooves 74, 74, 74 separated by single groove edges 76, 76 and having a double groove edge 75 at the top formed by arcuate surface 11*a* of forming ring 11 (See FIG. 3).

It should be noted that in the form of the invention shown, two internal support rolls 50 and 51 are illustrated in conjunction with three external finishing shaping rolls 61, 62 and 63. It is believed apparent, however, that the principle employed with regard to the internal rolls 50 and 51, namely the floating and automatic compensating capabilities thereof could be equally well employed with three, four or an almost infinite number of rolls simply stacked one on top of the other and interconnected by additional springs such as 52. Of course, the number of the final shaping rolls 61, 62 and 63 would have to be increased proportionately.

In any event, however, it is believed apparent that such structure will permit the forming of a pulley have three or more concentric, dynamically balanced peripheral grooves in its circumference from a single piece of stock and in a single operation without the need to move the part from one machine to the other as well as without the need for employing a complicated or complex internal chucking arrangement.

While a full and complete description of the invention has been set forth in accordance with the dictates of the Patent Statutes, it is believed that modifications can be resorted to without departing from the spirit hereof or the scope of the appended claims.

We claim:

1. Apparatus for producing cylindrical bodies having three or more V-shaped peripheral grooves therein from one piece of material, comprising:

(A) a rotary clamping chuck;

(B) a rotary support assembly for receiving the cylindrical body;

(C) said clamping chuck and said support assembly being movable relatively of each other to trap said cylindrical body therebetween;

(D) a rotary support roll assembly received within said cylindrical body and including at least two rotatably mounted unitary support rolls;

(E) spring means interconnecting said support rolls and normally urging them away from each other;

(F) a shaping roll assembly for grooving the exterior of said cylindrical body; and (G) said support assembly serving as a backup to said shaping roll assembly.

2. The apparatus of claim 1 wherein said rotary support roll assembly includes (A) a free wheeling spindle; and (B) said support rolls are secured to said spindle for rotational movement therewith.

3. The apparatus of claim 1 wherein said support rolls are eccentrically mounted with respect to the main axis of said rotary clamping chuck and said rotary support assembly.

4. The apparatus of claim 1 wherein (A) said shaping roll assembly includes a plurality of shaping rolls; and (B) said support rolls number one less than said shaping rolls.

5. A method of forming a cylindrical body having at least three V-shaped peripheral grooves therein from a single cup-shaped blank comprising the steps of (A) locating said blank on a rotary support assembly with at least two spring loaded unitary support rolls received within said blank;

(B) clamping said blank in place with a rotary clamping chuck;

(C) preforming said grooves with externally supported performing rolls; and (D) finish forming said grooves with externally supported finishing rolls in cooperation with said spring loaded support rolls;

(E) releasing said clamping chuck and removing said cylindrical body from said support rolls.

6. The method of claim 5 wherein (A) said finish forming rolls draw said blank in an axial direction; and (B) said support rolls move in an axial direction in response to the drawing action of said finish forming rolls.

* * * * *